United States Patent [19]

Veronesi et al.

[11] 4,181,471

[45] Jan. 1, 1980

[54] NUCLEAR REACTOR COOLANT PUMP HAVING A TOOLING BOOM

[75] Inventors: Luciano Veronesi, O'Hara Township, Allegheny County; Woodie R. Francis, Penn Township, Berks County, both of Pa.

[73] Assignee: Westinghouse Electric Corp., Pittsburgh, Pa.

[21] Appl. No.: 863,191

[22] Filed: Dec. 22, 1977

[51] Int. Cl.[2] ..... F04B 17/00

[52] U.S. Cl. ..... 417/360; 403/11

[58] Field of Search ..... 417/360; 403/11; 214/1 BC

[56] References Cited

U.S. PATENT DOCUMENTS

| | | | |
|---|---|---|---|
| 2,839,006 | 6/1958 | Mayo | 417/360 X |
| 3,135,397 | 6/1964 | Kull | 214/1 BC |
| 3,671,149 | 6/1972 | Fraser | 417/360 |

*Primary Examiner*—Carlton R. Croyle
*Assistant Examiner*—R. E. Gluck
*Attorney, Agent, or Firm*—L. A. DePaul; Z. L. Dermer

[57] ABSTRACT

Nuclear reactor coolant pump having a tooling boom mounted on the periphery of the motor stand of the pump for transferring pump components through openings in the motor stand during performance of maintenance on the pump. The tooling boom comprises an articulated arm mounted on the periphery of the motor stand with a gripping mechanism attached to the arm at the end opposite the arm's attachment to the motor stand. The gripping mechanism is capable of having pump components firmly attached thereto so that when the articulated arm is swung in the horizontal plane, the pump components may be transferred between the inside and outside of the motor stand.

6 Claims, 5 Drawing Figures

NUCLEAR REACTOR COOLANT PUMP HAVING A TOOLING BOOM

BACKGROUND OF THE INVENTION

This invention relates to reactor coolant pumps and particularly to reactor coolant pumps having an integral tooling boom for transferring pump components.

In nuclear reactor systems well known in the art, the nuclear reactor produces heat which is transferred therefrom to steam generating equipment by the reactor coolant. The steam thus produced is then used to generate electricity in a conventional manner. A reactor coolant pump is located in the system and is used to circulate the reactor coolant between the nuclear reactor and the steam generating equipment. One such reactor coolant pump is disclosed in copending application Ser. No. 730,056 filed Oct. 6, 1976 and entitled "Vertical Pump With Free Floating Check Valve" by M. Lindsay which is assigned to the assignee of the present invention.

Nuclear reactor coolant pumps generally comprise a pump housing enclosing the pump section with a motor housing enclosing the motor section vertically mounted on the pump housing by means of a motor stand. The electric motor has a vertical drive shaft that extends downwardly and is coupled with the vertical pump shaft of the pump section. In this manner, the motor causes the drive shaft to rotate which causes the pump shaft to rotate, thereby circultaing the reactor coolant through the reactor system. After a period of operation, it is generally necessary to perform routine maintenance on certain pump components, such as the shaft seals. In reactor coolant pumps wherein the motor drive shaft is bolted directly to the pump shaft, it is necessary to disconnect the drive shaft from the pump shaft and to disconnect the motor stand from the pump housing so that the motor stand and motor housing can be raised above the pump housing by an overhead crane, thereby providing access to pump components. In certain other pumps, generally known as spool type pumps, a spacer or spool is connected between the motor drive shaft and the pump shaft so that when disconnected from the drive shaft and pump shaft, the spool can be horizontally removed through openings in the motor stand without disconnecting the motor stand from the pump housing and without lifting the motor stand. In order to horizontally remove the spool, several metal rails are horizontally placed through the openings in the motor stand and are supported thereby. Conventional hoisting equipment that is capable of vertically lifting the pump components is then attached to the horizontal rails. When the pump component has thus been raised, rollers attached to the hoisting equipment are utilized to remove the component by rolling on the horizontal rails and out through the opening in the motor stand. While it is possible to use this system to remove components from a reactor coolant pump, under certain circumstances it may not be desirable because of the crowded location of the reactor coolant pump within the nuclear reactor system. This crowded condition prevents the rails from being extended to a location where the components may be easily accessed. Furthermore, the time necessary to assemble and disassemble this prior art system results in costly reactor down time. Therefore, what is needed is a reactor coolant pump having an integral tooling boom that is capable of transferring pump components through openings in the motor stand so that maintenance may be more quickly and easily performed.

SUMMARY OF THE INVENTION

Nuclear reactor coolant pump having a tooling boom mounted on the periphery of the motor stand of the pump for transferring pump components through openings in the motor stand during performance of maintenance on the pump. The tooling boom comprises an articulated arm mounted on the periphery of the motor stand with a gripping mechanism attached to the arm at the end opposite the arm's attachment to the motor stand. The gripping mechanism is capable of having pump components firmly attached thereto so that when the articulated arm is swung in the horizontal plane, the pump components may be transferred between the inside and outside of the motor stand.

BRIEF DESCRIPTION OF THE DRAWINGS

While the specification concludes with claims particularly pointing out and distinctly claiming the subject matter of the invention, it is believed the invention will be better understood from the following description taken in conjunction with the accompanying drawings, wherein:

DESCRIPTION OF THE PREFERRED EMBODIMENT

After a period of operation of a nuclear reactor coolant pump, it is sometimes necessary to perform routine maintenance on the pump components. The invention described herein provides a mechanism for easily removing the pump components through the motor stand without disconnecting the motor stand from the pump section.

Figure 1:
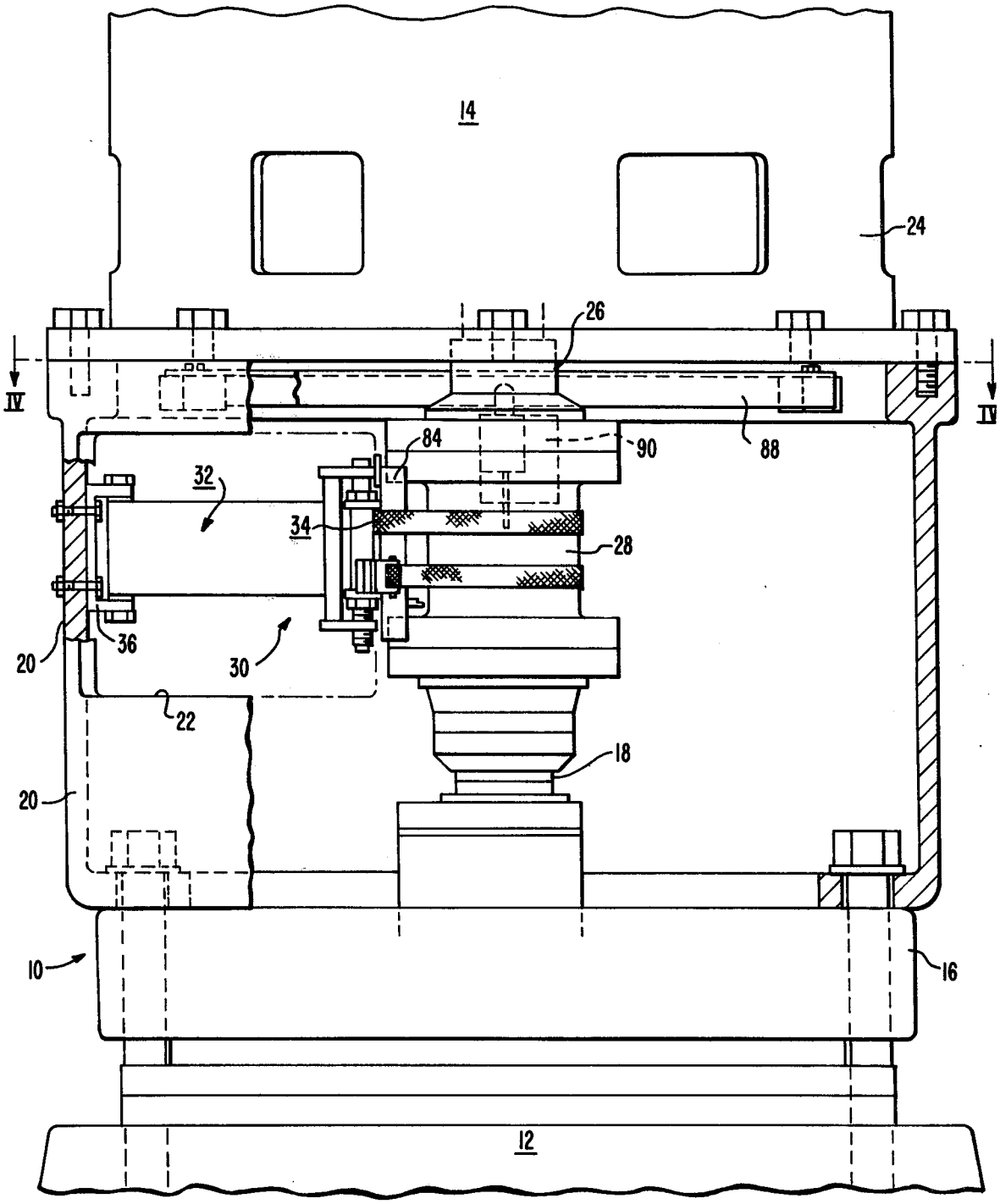
FIG. 1 is a partial view in elevation of a nuclear reactor coolant pump.

Referring to FIG. 1, a nuclear reactor coolant pump is referred to generally as 10 and comprises a pump 12 which is supported vertically from a stable support (not shown) and a motor 14. Pump 12 comprises a pump housing 16 which encloses components of pump 12 such as vertical pump shaft 18. A motor stand 20 having openings 22 is bolted to pump housing 16 for supporting motor 14. Motor 14 which is generally an electric motor is enclosed within motor housing 24 which is bolted to motor stand 20. Thus motor 14 is supported vertically from pump 12 by motor stand 20. Motor 14 has a vertical drive shaft 26 which extends toward pump shaft 18. A spool 28 is bolted to drive shaft 26 and to pump shaft 18 thereby connecting drive shaft 26 to pump shaft 18. Spool 28 serves as a spacer between drive shaft 26 and pump shaft 18 that can be unbolted and horizontally removed, thereby providing space between drive shaft 26 and pump shaft 18 for accessing other components of pump 12. When energized, motor 14 causes drive shaft 26 to rotate which causes pump shaft 18 to also rotate. The rotation of pump shaft 18 causes the reactor coolant to be circulated between the nuclear reactor and steam generating equipment, all in a manner well understood by those skilled in the art.

Figure 2:
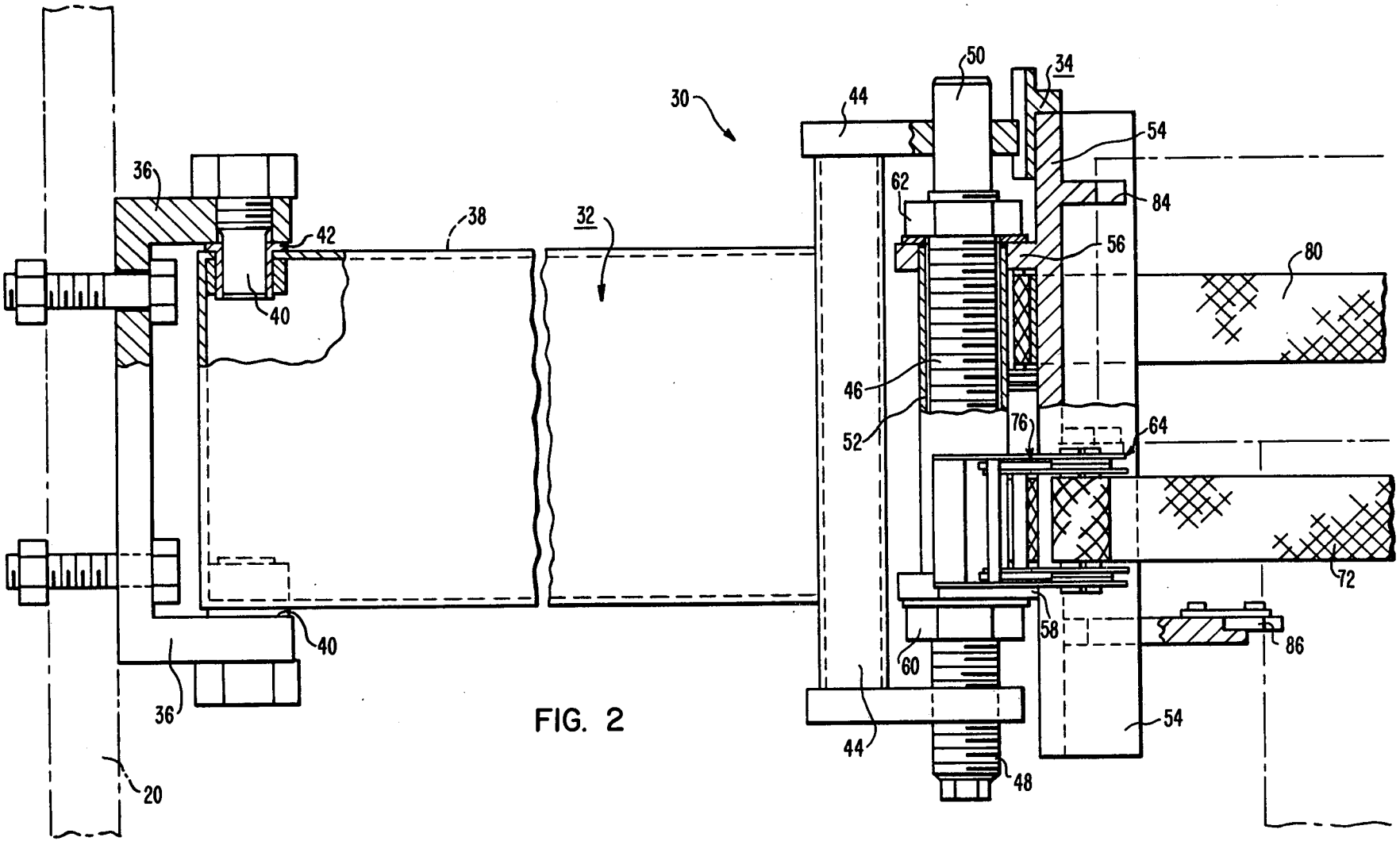
FIG. 2 is a view in elevation of the tooling boom.
Figure 3:
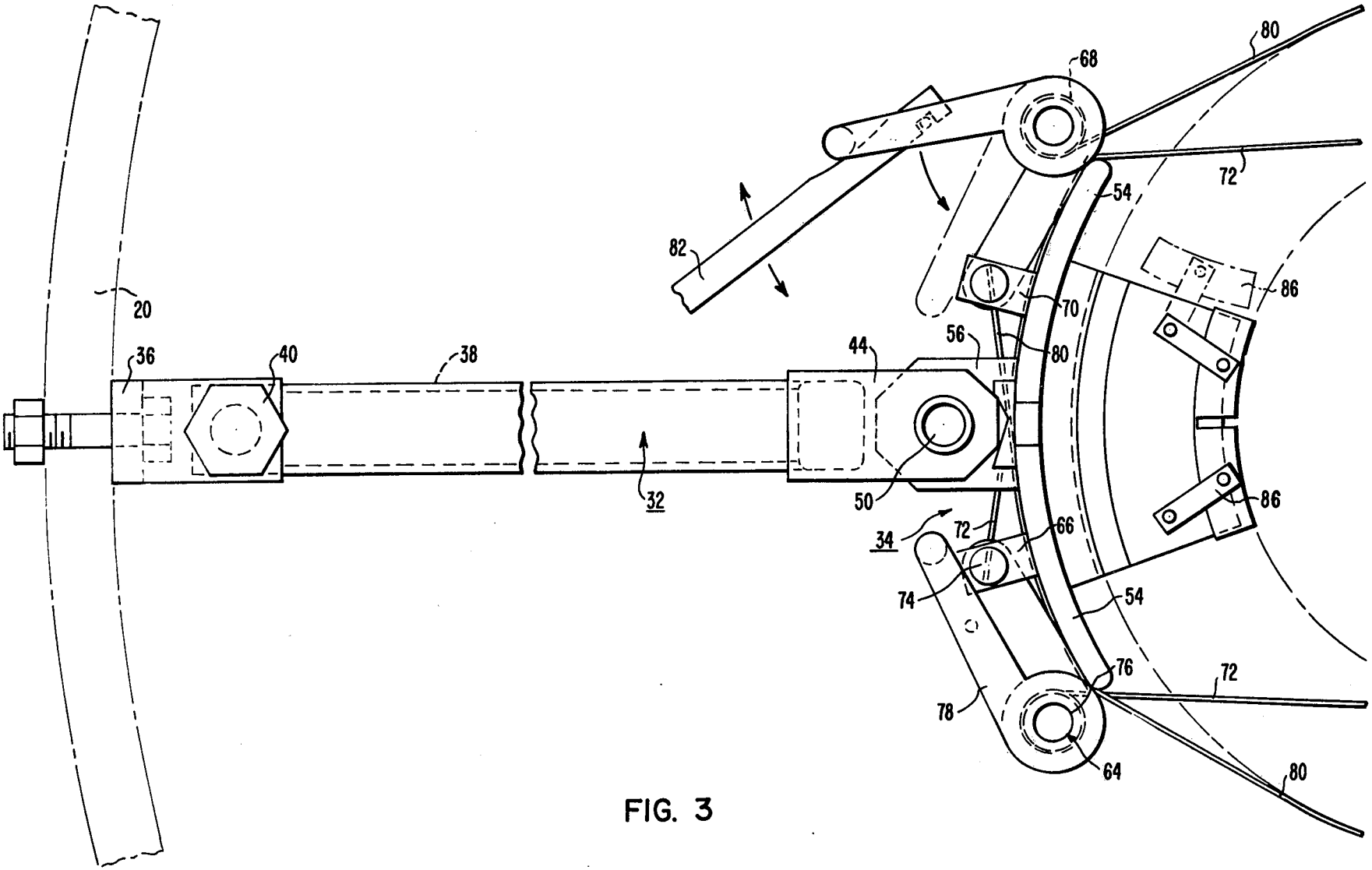
FIG. 3 is a plan view of the tooling boom.

Referring now to FIGS. 1, 2 and 3, a tooling boom referred to generally as 30 comprises an articulated arm 32 and a gripping mechanism 34 for removing components such as spool 28 from the motor stand 20 through openings 22. Articulated arm 32 comprises a bracket 36 which may be bolted to motor stand 20. FIGS. 1, 2 and 3 show bracket 36 as being attached to motor stand 20 on the inside thereof; however, bracket 36 may be alternatively attached to the outside of motor stand 20. A horizontal bar 38 which may be a single member or more than one member movably connected is pivotably attached to bracket 36 by means of pins 40. Bearings 42 chosen from those well known in the art are disposed in horizontal bar 38 so that pins 40 may be rotatably disposed therein thereby allowing horizontal bar 38 to pivot about pins 40 in a horizontal plane. Gripping mechanism 34 comprises a mounting member 44 which is attached to horizontal bar 38 at the end of horizontal bar 38 opposite bracket 36. A threaded member 46 which is threaded substantially its entire length has a first end 48 disposed in a threaded portion of mounting member 44 and has a second end 50 not being threaded and slidably disposed in another portion of mounting member 44. First end 48 has threads that engage threads of mounting member-44 such that when first end 48 is rotated, threaded member 46 advances relative to mounting member 44 by means of the threaded interconnection while second end 50 slides relative to mounting member 44. Mounting member 44 carries the weight of threaded member 46 and components attached thereto. A sleeve 52 is rotatably mounted on threaded member 46 between first end 48 and second end 50. A support member 54 which may be a member having a substantially circular curvature has a first shoulder 56 and a second shoulder 58, each having a hole therein through which threaded member 46 and sleeve 52 are disposed. A first nut 60 is threaded onto first end 48 so that the lower end of sleeve 52 is held in position thereby while a second nut 62 is similarly located on second end 50. When first nut 60 is rotated into close contact with the lower end of sleeve 52 and second nut 62 is similarly rotated into close contact with the upper end of sleeve 52, then sleeve 52 and support member 54 are firmly positioned with respect to threaded member 46. In addition, washers may be disposed between first nut 60 and the lower end of sleeve 52 and between second nut 62 and the upper end of sleeve 52. Positioning of first nut 60 and second nut 62 thus determines the vertical position of support member 54 relative to threaded member 46. However, since sleeve 52 extends through first shoulder 56 and second shoulder 58, which are integral with support member 54, support member 54 may pivot in a horizontal plane with respect to threaded member 46 even with first nut 60 and second nut 62 firmly locked in place. Therefore, by repositioning first nut 60 and second nut 62 with respect to threaded member 46, support member 54 may also be vertically moved relative thereto while maintaining its horizontal pivotability. Of course, since first end 48 is threaded into mounting member 44 by rotating first end 48 threaded member 46 and support member 54 may be vertically moved relative to horizontal bar 38. A first binding mechanism 64 is attached to support member 54 by first attachment 66 while a second binding mechanism 68 is attached to support member 54 by second attachment 70. Binding mechanisms 64 and 68 may be chosen from those well known in the art and may be ratchet buckles manufactured by the Ancra Corp. of El Segunda, California. First binding mechanism 64 has a first strap 72 which may be a nylon strap that is attached to first binding mechansim 64 at location 74 and extends toward second binding mechanism 68, along support member 54, around the component to be supported, and back into contact with first binding mechanism 64 at ratchet mechanism 76. Ratchet mechanism 76 has a handle 78 connected thereto that when reciprocally manipulated causes first strap 72 to be tightened around the component. Second binding mechanism 68 which operates similarly to first binding mechanism 64 also has a second strap 80 which extends around the component to be moved, but at an elevation different from that of first strap 72. In addition, an extension handle 82 may be attached to a handle of the binding mechanisms to provide better leverage for tightening the straps.

Referring to FIGS. 1, 2 and 3, support member 54 has notches 84 therein which are designed to be abutted against a surface of the component to be transported so as to vertically support the weight of the component while straps 72 and 80 stabilize the component and prevent the component from turning. More than one notch 84 may be provided at various locations on support member 54 so as to enable support member 54 to vertically support components of various shapes and sizes. In addition, spacers 86 may be movably mounted on support member 54 so as to be able to be moved into contact with the component. Spacers 86 not only vertically support the component to be transported but also stabilize the component to prevent the component from rotating. The adjustability of spacers 86 provides the capability of supporting numerous shapes and sizes of components.

Figure 4:
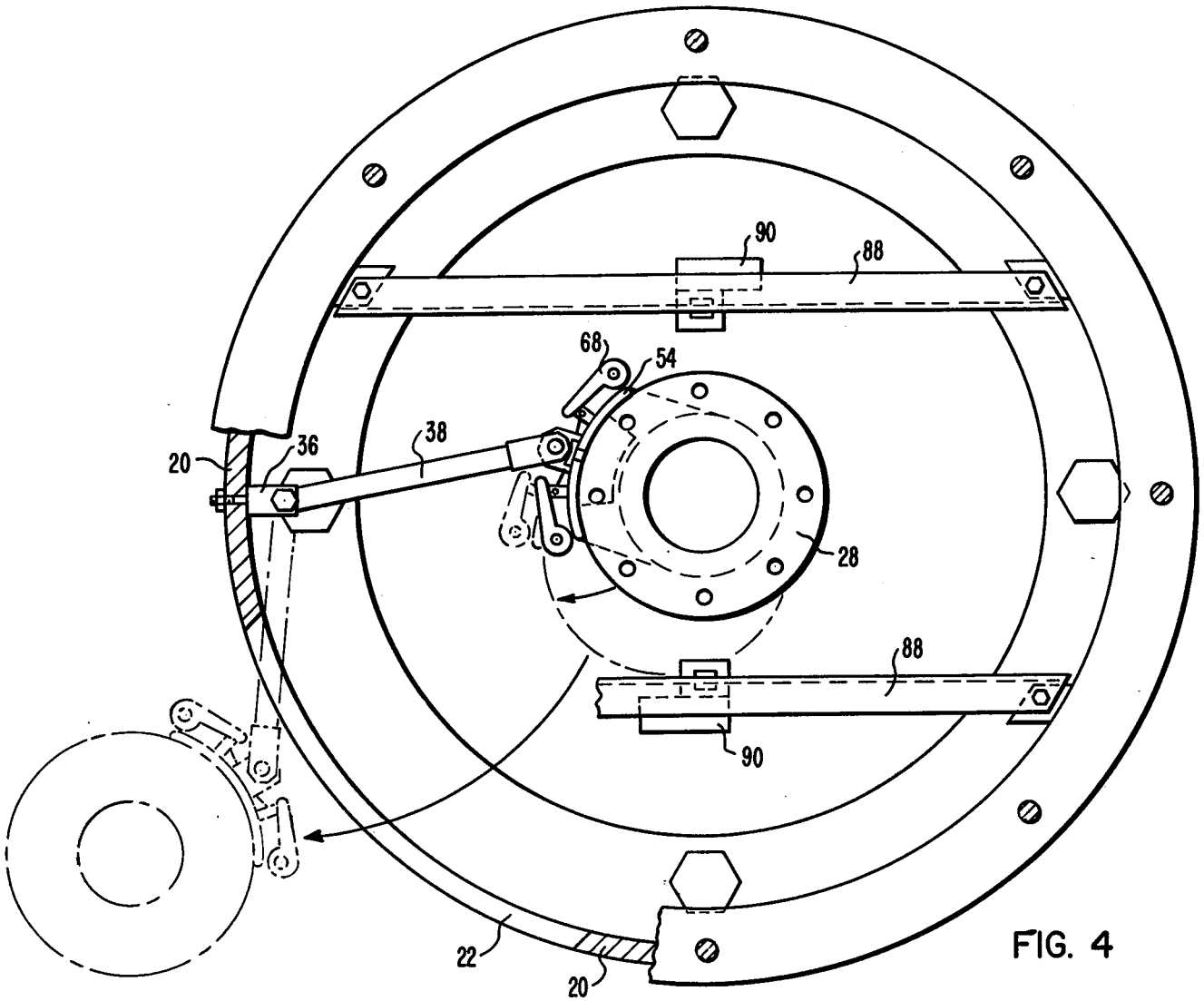
FIG. 4 is a view along line IV—IV of FIG. 1.

Referring now to FIGS. 1 and 4, two parallel rails 88 are bolted to motor stand 20 so as to extend over tooling boom 30 and two hoisting mechanisms 90 which may be motor driven chain-sprocket arrangements are attached to rails 88 in alignment with pump shaft 18. Hoisting mechanisms 90 provide the capability of vertically moving the component to be transported so that the component will be at the same elevation as tooling boom 30 so that tooling boom 30 may move the component through openings 22 of motor stand 20.

Figure 5:
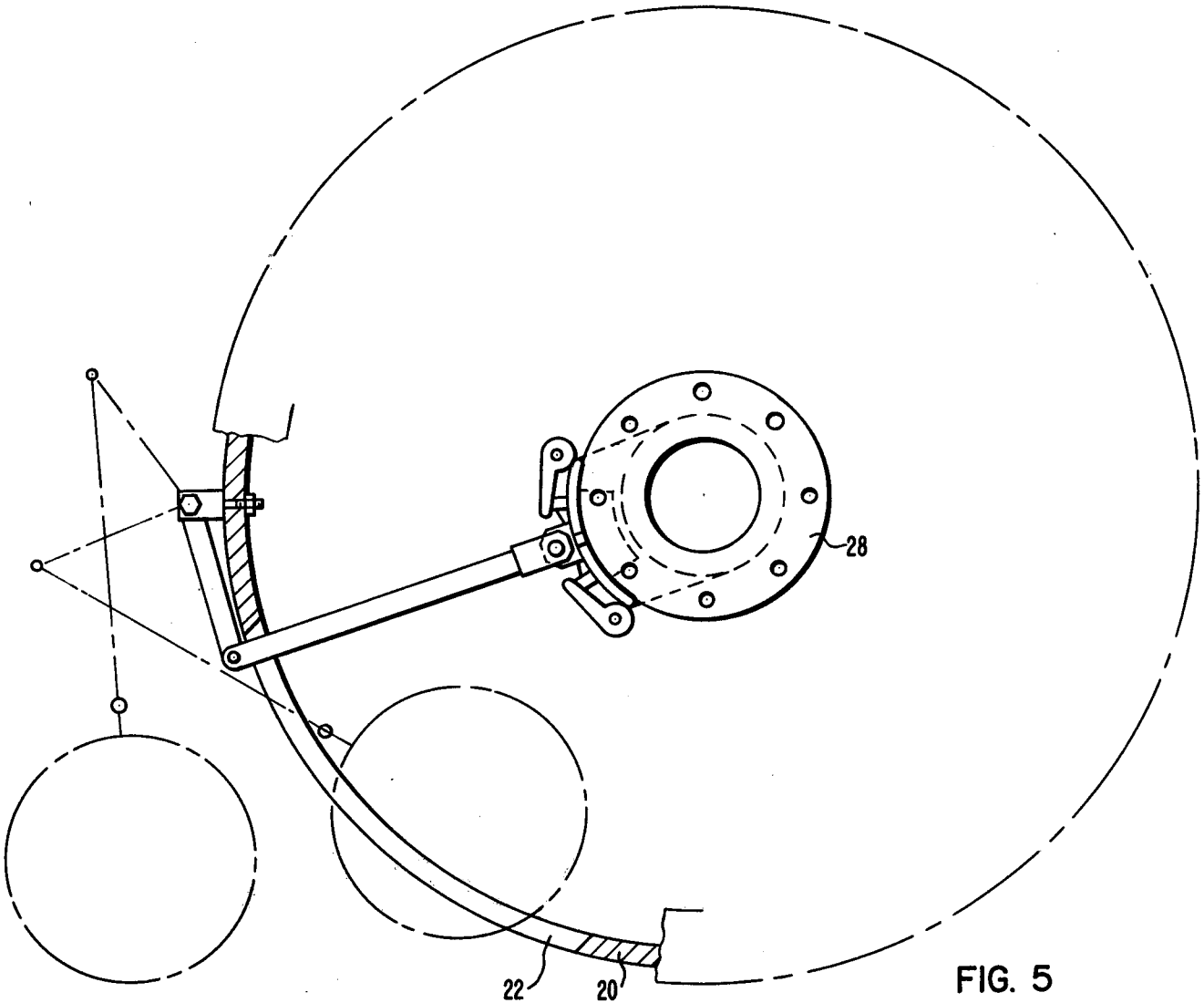
FIG. 5 is an alternate plan view of the tooling boom.

FIG. 5 illustrates an alternate embodiment of tooling boom 30 wherein articulated arm 32 has two movable segments and is attached to the outside of motor stand 20. Both embodiments are capable of performing the same functions and are interchangeable or may be used together. When utilized together, the tooling boom mounted on the inside of motor stand 20 transports the component through an opening 22 where the component is transferred to the outer tooling boom which then further transports the component. By using both tooling booms, a greater range of motions and area are attainable. This may be important where the area near the opening 22 is conjested while an area out of reach of a single tooling boom is clear.

OPERATION

After a period of operation, it is sometimes necessary to repair or replace certain components of pump 12 such as the shaft seals (not shown). When this is necessary, tooling boom 30 is mounted on motor stand 20 as previously described or tooling boom 30 may be permanently installed thereon. Articulated arm 32 is then pivoted toward spool 28 and gripping mechanism 34 is brought near spool 28. At this point, either notches 84 or spacers 86 are aligned with the appropriate surfaces of spool 28 so that they may be brought into contact therewith. Support member 54 may then be moved relative to threaded member 46 by means of first nut 60 and second nut 62, if desired. Threaded member 46 is then rotated, which causes it to be vertically advanced relative to horizontal bar 38. Support member 54 being attached to threaded member 46 is also advanced. Threaded member 46 is thus advanced until notches 84 or spacers 86 are brought into contact with spool 28. First strap 72 and second strap 80 are then extended around spool 28 and into contact with its respective binding mechanism 64 or 68. The handles of the binding mechanism are then utilized to tighten first strap 72 and second strap 80 into close contact with spool 28. Spool 28 may then be unbolted from drive shaft 26 and pump shaft 18. At this point, spool 28 may be horizontally moved through opening 22 of motor stand 20 by pivoting tooling boom 30 as shown in FIG. 4. In this manner, spool 28 may be removed from motor stand 20. In the reverse manner, spool 28 may be transferred into place between drive shaft 26 and pump shaft 18. Other components surrounding pump shaft 18 may be similarly transferred by first vertically moving the component by means of hoisting mechanisms 90. Hoisting mechanism 90 serve to vertically transfer the component to approximately the same elevation as spool 28 so that tooling boom 30 may have access to it. Therefore, the invention provides a reactor coolant pump having an integral tooling boom that is capable of transferring pump components through openings in the motor stand so that maintenance may be more quickly and easily performed.

We claim as our invention:

1. A vertical pump having a tooling boom comprising:

a pump having a vertical pump shaft;

a motor stand having openings therein and mounted on said pump;

a motor having a vertical drive shaft and mounted on said motor stand with said drive shaft being coupled to said pump shaft, said motor driving said pump by means of said drive shaft and said pump shaft; and an articulated arm having a first end attached to said motor stand and having a second end capable of being extended near said pump shaft with a gripping mechanism attached to said second end for grasping components of said pump and transferring said components through one of said openings in said motor stand.

2. The pump according to claim 1 wherein said gripping mechanism comprises:

a mounting member attached to said second end of said articulated arm with a vertical threaded member mounted on said mounting member and a support member having a substantially circular curvature disposed on said vertical threaded member for supporting the weight of the components to be transferred, with said vertical threaded member being capable of adjusting the vertical location of said support member relative to said mounting member; and a binding mechanism attached to said support member for stabilizing said components during transport.

3. The pump according to claim 2 wherein said gripping mechanism further comprises:

a sleeve disposed around said vertical threaded member with said support member attached to said sleeve; and a first nut mounted on said vertical threaded member above said sleeve and a second nut mounted on said vertical threaded member below said sleeve for adjusting the location of said support member relative to said vertical threaded member.

4. The pump according to claim 3 wherein said gripping mechanism further comprises spacers mounted on said support member for contacting said components thereby supporting the weight of said components and preventing rotation of said components relative to said support member.

5. The pump according to claim 4 wherein said binding mechanism comprises a ratchet binder mounted on said support member having a strap attached thereto that is capable of being extended around said component with said ratchet binder tightening said strap thereby holding said component against said support member.

6. The pump according to claim 5 wherein said strap is a nylon strap.

* * * * *